US005971201A

United States Patent [19]

Daw

[11] Patent Number: 5,971,201

[45] Date of Patent: Oct. 26, 1999

[54] TRIM JOB

[76] Inventor: Brian Edwin Daw, 23425 97th Ave. N., Port Byron, Ill. 61275

[21] Appl. No.: 09/010,557

[22] Filed: Jan. 22, 1998

[51] Int. Cl.[6] ..... B65D 25/00; B65D 25/28

[52] U.S. Cl. ..... 220/697; 220/702; 220/771; D32/53.1

[58] Field of Search ..... 220/697, 702, 220/696, 771, 570; D32/53.1

[56] References Cited

U.S. PATENT DOCUMENTS

| | | | |
|---|---|---|---|
| 1,590,572 | 6/1926 | Fredette | 220/505 X |
| 3,395,828 | 8/1968 | Schnabel . | |
| 3,407,429 | 10/1968 | DiNardo . | |
| 4,363,433 | 12/1982 | Jacques | 224/674 |
| 4,491,234 | 1/1985 | Wilcock | 220/697 |
| 4,722,442 | 2/1988 | Smith . | |
| 4,771,501 | 9/1988 | Leiter | 220/697 |
| 4,852,759 | 8/1989 | Williams et al. . | |
| 4,927,046 | 5/1990 | Armstrong | 220/697 |
| 5,489,051 | 2/1996 | Robinson | 292/150 |

FOREIGN PATENT DOCUMENTS

| | | | |
|---|---|---|---|
| 1038672 | 9/1953 | France | 220/771 |
| 2231857 | 11/1990 | United Kingdom | 220/697 |

*Primary Examiner*—Allan N. Shoap
*Assistant Examiner*—Joe Merek
*Attorney, Agent, or Firm*—Patent & Trademark Services; Thomas Zack; Joseph H. McGlynn

[57] ABSTRACT

A paint container and brush holder made as a unitary mold structure having a built-in paint brush holder compartment and a stationary handle, and at least one tilted side brush holder wall with a bottom with lower paint drain holes. A lower paint reservoir with a substantially opened top may have four or three joined walls and a bottom. With three joined side reservoir walls, a triangular configuration is formed while the four side walls version forms either a rectangular or square configuration. In either embodiment paint from any stored brush in the brush holder compartment drains through lower compartment holes into the lower reservoir. Tilted walls in the brush compartment may be used to rest the brush against them or to wipe off any excess brush paint which then gores into the brush holder's drain holes. A pour spout molded into the intersecting walls of the reservoir, allows any unused paint to be put back into its original shipping paint can after work is completed. By storing and transporting the paint and its paint brush with this unitary structure, there is a lessen chance for paint spillage during transport.

3 Claims, 1 Drawing Sheet

TRIM JOB

BACKGROUND OF THE INVENTION

Painters who used brushes often spill paint when moving the brush and its paint container to different location. This is especially true when going up and down ladders when the users concentration is divided between staying on the ladder and keeping the brush and paint container from dripping paint. The semi-circular thin wire bail wire handle typical found on many paint cans or containers is pivotally attached to the can its ends adding providing added degree of movement which adds to the balancing act required as the user moves the container from place to place. To compensate for these concerns attachments and accessories usable with paint containers have been designed that seek to reduce or eliminate the possibility of the spillage of paint as the container is moved. Each such improvement provides a degree of success. However, none provides the multiple convenience of a paint container that has an easy to carry stationary handle, a built-in brush holder with its own tilted excess paint drain that communicates with lower reservoir and an easy to pour spout all as more fully described herein.

DESCRIPTION OF THE PRIOR ART

Paint container accessories which assist in reducing the amount of paint spillage are known. For example, in the Schnabel invention (U.S. Pat. No. 3,395,828) a paint can tray attachment is disclosed having a large central opening, a series of perforated drip openings and a ribbed brush roller.

The DiNardo invention (U.S. Pat. No. 3,407,429) describes a can apron and brush holder mounted to the can's top with a lower drip apron detachably secured to the can's bottom.

In the Smith reference (U.S. Pat. No. 4,722,442) a drip shield is disclosed which is detachably secured to the paint can's bottom and has a paint containment chamber to receive and retain paint spilled down the can's sides.

In U.S. Pat. No. 4,852,759 to Williams et al. a paint trim tray is described having a planar bottom with angulated walls and a pour spout. In contrast to these inventions and the known prior art, the present invention provides for a single paint container that has a built-in carrying handle, a built-in brush holder with tilted walls and drain holes communicating with a lower paint reservoir and a pour spout on the reservoir as more further set forth in this specification.

SUMMARY OF THE INVENTION

This invention relates to a paint container having a built-in brush holder and handle, tilted brush holder walls associated with a drain, and a lower paint reservoir having a pour spout for the reservoir.

It is the primary object of the present invention to provide for an improved paint and paint brush container.

Another object is to provide for such a device wherein drain holes within the container allow paint to drip from the stored brushes back into a lower paint reservoir.

These and other objects and advantages of the present invention will become apparent to readers from a consideration of the ensuing description and the accompanying drawings.

DESCRIPTION OF THE PREFERRED EMBODIMENT

Figure 1:
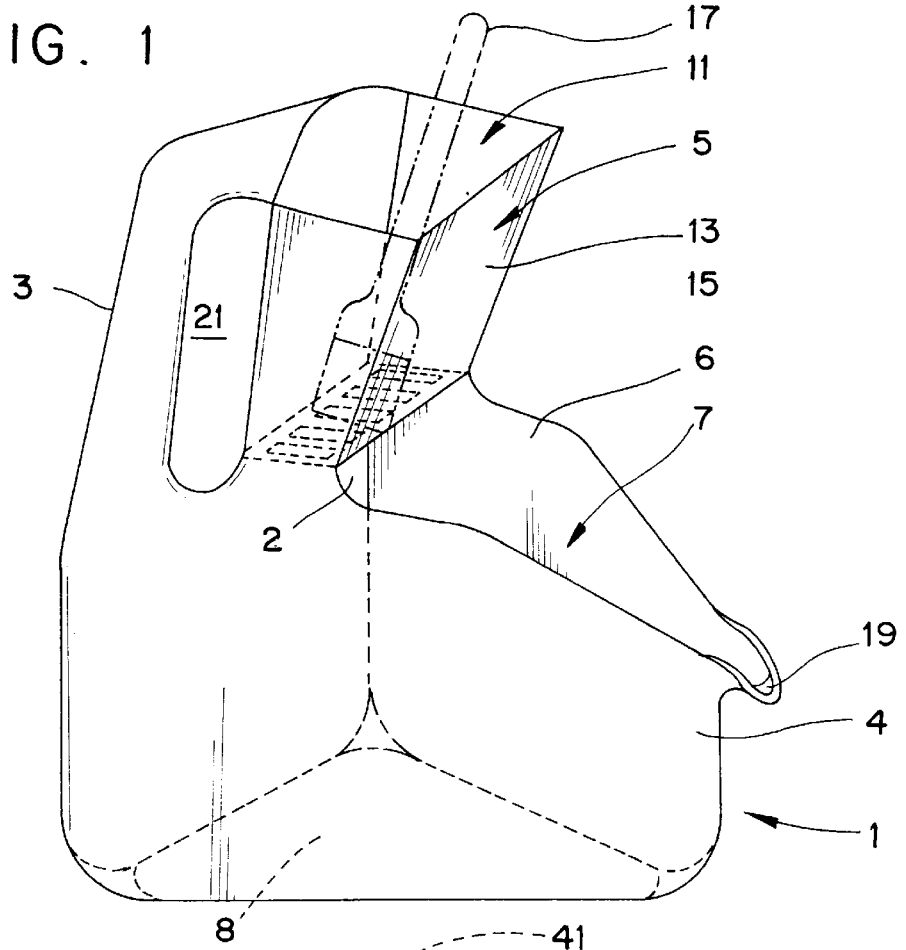
FIG. 1 is a side perspective view of a first embodiment of the invention with a triangular shaped paint reservoir.

FIG. 1 is a side perspective view of a first embodiment of the invention with a triangular shaped paint reservoir. A molded plastic container 1 with a built-in rear molded handle 3 has an upper opened paint brush receiving top opened holder compartment 5 and a lower paint receiving and storing triangular shaped reservoir 7. The handle 3 is built-into the container and is rigidly fixed to the brush holder compartment 5 at its top and to the back part of the adjacent back reservoir wall 2 forming part of the lower paint reservoir. In this first embodiment, the container's reservoir is formed by three joined side walls—the back wall 2 and the two side walls 4 and 6—with a lower joined triangular shaped bottom 8 (shown in dotted line format). Providing communication between with the paint brush holder compartment 5 and the lower paint reservoir 7 are a series of lower drain holes 9 formed by spaced openings located in the bottom of the brush holder compartment.

The paint brush holder compartment 5 has an opened top 11, and four side walls including a back wall 12, two side walls and the front wall 13. At least one of the brush compartment walls, shown here as the front wall 13, is angled both inwardly and downwardly less than 90 degrees from vertical from the wall's top to the lower bottom brush compartment surface 15 which contains the spaced paint drain holes 9. With this tilted construction for one or more of the brush holder compartment walls, a paint brush 17 (shown in dotted line format) inserted into the compartment with its bristles down can have its excess paint wiped off the brush on the interior tilted compartment wall(s) by pressing the brush's bristles against them and then have the brush rested against the wall 13 allowing any more excess paint to run down the holder's tilted side walls into the drain holes and into the communicating lower paint reservoir 7. If desired, one or more wet or dry paint brushes can be stored in a similar manner in the brush holder compartment 5 at one time and be conveniently transported by a user.

In FIG. 1 the lower opened top paint reservoir 7 has side walls that are generally triangular in shape, when viewed from above, with a formed pour spout 19 located at upper part of the triangle wall's joined apex most remote from the brush holder's drain holes and the reservoir's rear wall 2. This upper walled pour spout extends outwardly from the reservoir walls and permits excess paint, not used in the painting job, to be poured back into the the original paint shipping container or can after the job has been completed. The completely or semi-opened reservoir top allows a painter to dip their brush bristles into the reservoir's contained paint while performing a painting job.

The container's carrying handle 3 has an opened hand grip formed by a hand receiving hole 21 which allows the easy hand gripping by a user when transporting or moving the container, such as up or down a ladder. This stationary handle built into and joined to the container's rear wall 2 and to upper rear wall brush holder compartment insures that handle will not pivot to tilt the carried paint to spill the paint or to drop the carried brush such as may occur in a typically opened paint can with a pivotal attached handle while carrying the can with a brush laid across its opened top.

Figure 2:
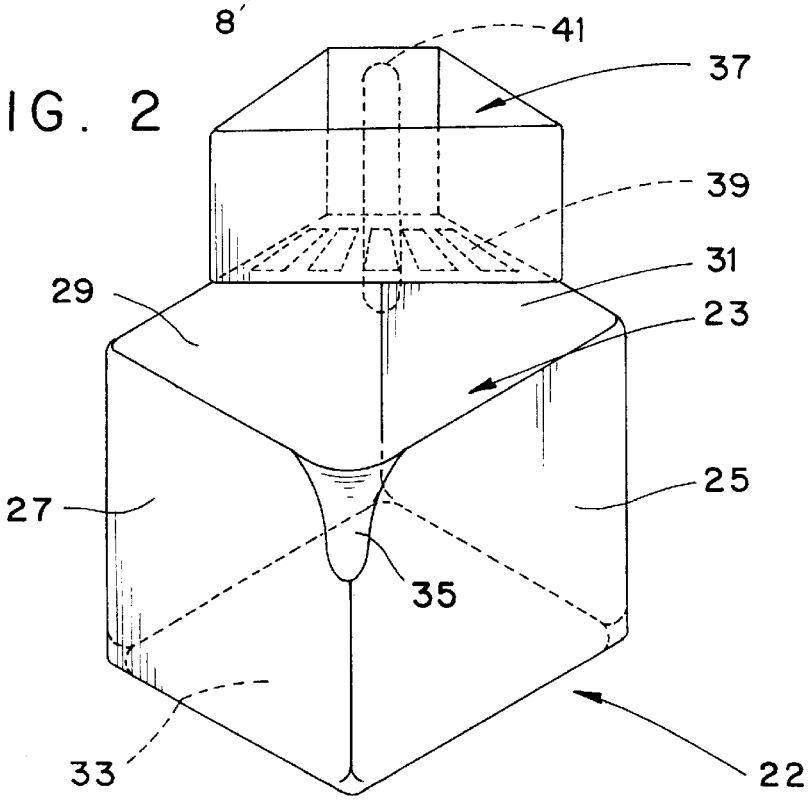
FIG. 2 is a front perspective view of a second embodiment of the invention with a square shaped paint reservoir.

The second container 22 embodiment (FIG. 2) is essentially the same as the first embodiment except that its paint reservoir is formed by four walls instead of three. The reservoir's four joined side walls (25,27,29 and 31) when viewed from above form a rectangular or square configuration and have an appropriated shaped rectangular bottom 33 (partially shown). With the reservoir walls configured in a rectangular shape, such as a square, its outwardly extending pour spout 35 is located at the upper part of a edge formed by the joined walls 25 and 27 located remote from the brush holder compartment's 37 lower paint drain holes 39. Shown by dotted lines is the container's rear handle 41, similar to handle 3 of the first embodiment, which is molded and fixed into the container's rear portion behind the brush holder compartment 37 and the lower paint reservoir 23 and has an appropriate hand opening. Brush holder compartment 37, like brush holder compartment 5, has at least one side wall that is tilted downwardly and inwardly from vertical to permit a paint brush to wipe on it or to lean against it during storage or transport.

Both containers 1 and 22 including their built-in handles, brush holder compartments and paint reservoirs and pour spouts, may be formed as a single unitary structure by the plastic injection molding process. Injection molding is a plastic molding process whereby heat softened plastic material is forced under very high pressure into a metal cavity mold, usually aluminum or steel, which is relatively cool. The inside cavity of the mold is comprised of two or more halves, and is the same desired shape as the product to be formed (in this case the container). High pressure hydraulics are used to keep the mold components together during the actual injection phase of the molding process. The injected plastic is allowed to cool and harden in the mold. The hydraulics holding the multiple component mold cavity together are released, the mold halves are separated and the solid formed plastic item is removed. Injection molding can be highly automated process and is capable of producing extremely detailed parts at a very cost effective price. The process should be invaluable in producing this invention's container's cost effectively.

Clearly, other materials and methods of manufacture may be used to make the containers other than the described plastic injection molding process. What is important is that the container, its paint reservoir, brush holder and handle be made of a rigid unitary design to insure that when transporting the container and a paint brush there be little or no spillage of paint from the stored brush or its paint reservoir during the movement of the container. Other configuration could conceivably be used to configure the paint reservoir. Whatever the specific design configuration chosen for the reservoir walls, this general design provides for such with a environmentally safer paint transport container with or without a more secured brush within holding compartment.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A paint container and paint brush holder comprising:

a paint container having a built-in paint brush holder, a built-in handle, and a paint reservoir; intermediate parts of the paint brush holder and the handle are spaced above the upper most part of the reservoir said brush holder having an opened top with side walls and drain holes communicating with said paint reservoir whereby paint within the paint brush holder may drain from the holder into the the container's lower paint reservoir, and wherein said paint reservoir is formed by intersecting container walls with a pour spout located at the intersection of two of the container's walls, and wherein said container including its built-in handle, brush holder and paint reservoir are made as a unitary plastic structure.

2. The paint container and paint brush holder as claimed in claim 1, wherein said container including its built-in handle, brush holder and paint reservoir are made as a unitary molded plastic material.

3. The paint container and paint brush holder as claimed in claim 2, wherein the container is manufactured using the plastic injection molding process.

* * * * *